US005959825A

United States Patent [19]

Harcombe

[11] Patent Number: 5,959,825

[45] **Date of Patent: *Sep. 28, 1999**

[54] SYSTEM AND METHOD FOR CONTROLLING FLOW OF CURRENT IN CONTROL VALVE WINDING

[75] Inventor: Anthony Thomas Harcombe, Surrey, United Kingdom

[73] Assignee: Lucas Industries plc, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/817,196

[22] PCT Filed: Oct. 13, 1995

[86] PCT No.: PCT/GB95/02425

§ 371 Date: May 29, 1997

§ 102(e) Date: May 29, 1997

[87] PCT Pub. No.: WO96/12098

PCT Pub. Date: Apr. 25, 1996

[30] Foreign Application Priority Data

Oct. 13, 1994 [GB] United Kingdom ..... 9420617

[51] Int. Cl.[6] ..... H01H 47/32

[52] U.S. Cl. ..... 361/154; 361/152

[58] Field of Search ..... 361/152–156, 361/159

[56] References Cited

U.S. PATENT DOCUMENTS

| | | | |
|---|---|---|---|
| 4,266,261 | 5/1981 | Streit et al. | 361/154 |
| 4,347,544 | 8/1982 | Ohba | 361/154 |
| 4,511,945 | 4/1985 | Nielsen | 361/154 |
| 5,245,501 | 9/1993 | Locher et al. | 361/154 |
| 5,539,608 | 7/1996 | Hurley et al. | 361/152 |
| 5,650,909 | 7/1997 | Remele et al. | 361/154 |

FOREIGN PATENT DOCUMENTS

| | | | |
|---|---|---|---|
| 040038993 | 5/1990 | European Pat. Off. | H01H 47/04 |

*Primary Examiner*—Jeffrey Gaffin
*Assistant Examiner*—Kim Huynh
*Attorney, Agent, or Firm*—Andrus, Sceales, Starke & Sawall

[57] ABSTRACT

A control valve of an engine fuel system includes a valve member which is coupled to an armature and is moved to engage a seating when a winding is energized. The current flow in the winding is first allowed to rise to a peak value to initiate movement of the armature and valve member at which time the winding is disconnected from the supply. The decay of current in the winding is controlled using two rates of current decay to ensure that the valve member moves into engagement with the seating with the minimum of bounce.

14 Claims, 4 Drawing Sheets

FIG. 2
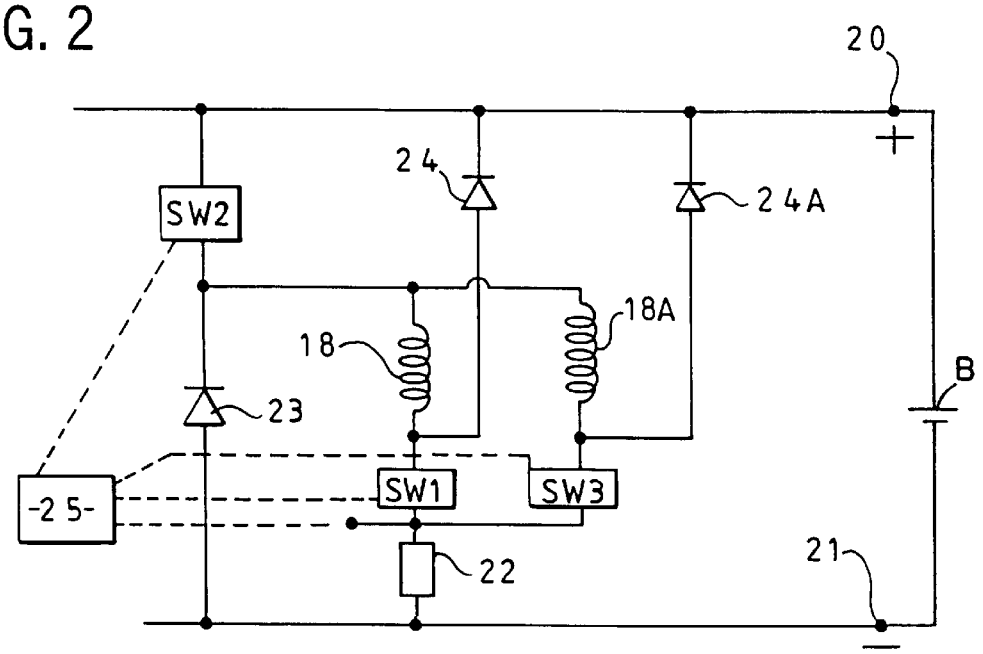
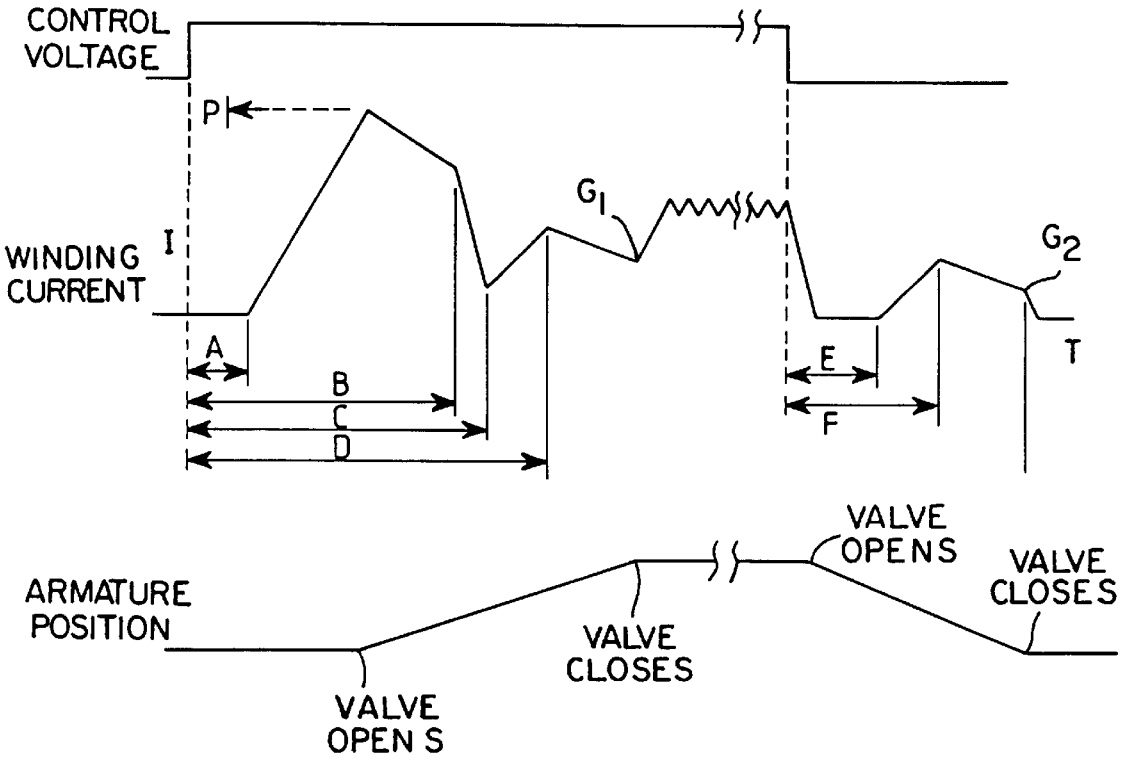
FIG. 3

SYSTEM AND METHOD FOR CONTROLLING FLOW OF CURRENT IN CONTROL VALVE WINDING

CROSS REFERENCE TO RELATED APPLICATIONS (Not Applicable)

STATEMENT REGARDING FEDERALLY SPONSORED RESEARCH (Not Applicable)

BACKGROUND AND SUMMARY OF THE INVENTION

This invention relates to a method of controlling the flow of current in a winding which forms part of a liquid control value more particularly a spill valve of an engine fuel system.

EP-A-0376493 discloses a method of controlling the flow of current in a winding in which the current is allowed to rise to a peak value and is then allowed to decay initially at a low rate and then at a higher rate until it reaches a value which is below a holding value, the current then being increased to the holding value. The current can be allowed to rise and fall to maintain a mean hold value. The armature which is associated with the winding starts to move under the influence of the magnetic field produced by the winding in the latter portion of the period during which the current is rising to the peak value and reaches its final position at or just before the attainment of the holding value of current. GB-A-2025183 discloses a method of controlling the flow of current in which the current is allowed to reach a high peak value and then before the associated valve reaches its final position, modifying the current flow.

In an engine fuel system it is important to know when a valve member forming part of the control valve attains its closed position and in a fuel system which employs a number of such valves it is important that each valve closes at the same time in its cycle of operation. It is desirable that the valve member should reach its closed position as soon as possible following the initiation of current flow but at the same time it is important to ensure that valve bounce is minimised. The knowledge of the point of valve closure enables the instant of valve closure to be varied to ensure correct operation of the engine.

SAE paper 861049 p153, 154 discusses the detection of valve closure in an engine fuel system and also discusses the adjustment of the start of the valve closure sequence in order to compensate for variation of battery voltage and other variables such as the resistance and inductance of the solenoid of the actuator controlling the valve.

WO87/05662 discloses a system for monitoring the opening of a valve in an engine fuel system, the valve being coupled to the armature of an electromagnetic actuator. The solenoid of the actuator is connected to a low voltage source at the time when the valve assumes its fully open position and this allows detection of a discontinuity in the current flowing in the solenoid. However, the connection of the solenoid to the low voltage source does slow the movement of the valve to the open position.

The object of the present invention is to provide a method of controlling the flow of current in a winding of the kind specified in a simple and convenient form.

BRIEF DESCRIPTION OF THE SEVERAL VIEWS OF THE DRAWINGS

In the accompanying drawings:

FIG. 2 shows a diagram for the power circuit which then controls the flow of electric current in a winding forming part of the fuel system of FIG. 1;

FIG. 3 shows the waveform of the current flow in the winding and the movement of the associated armature;

DETAILED DESCRIPTION OF THE INVENTION

Figure 1:
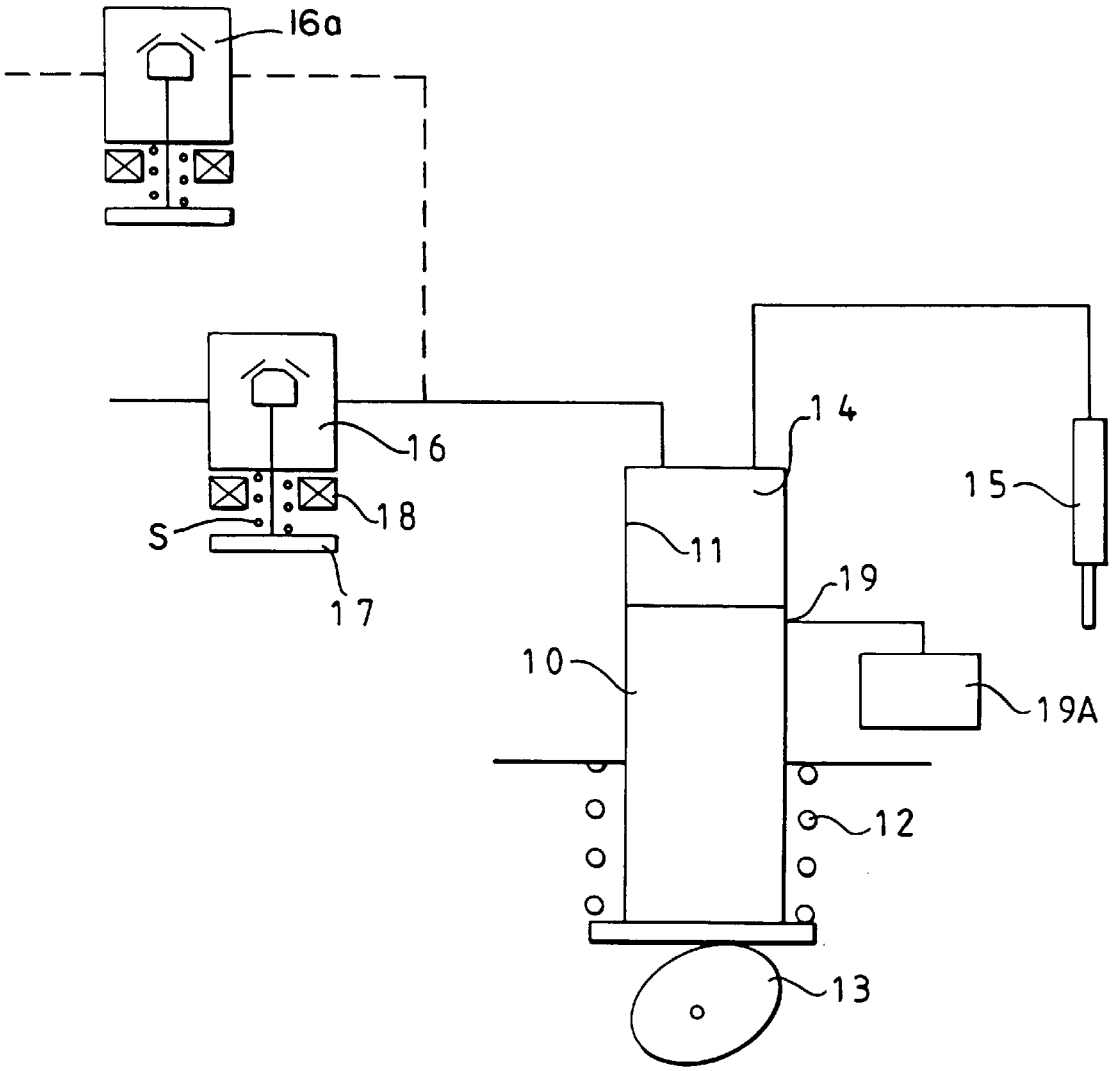
FIG. 1 shows in diagrammatic form one part of a fuel system for an internal combustion engine.

With reference to FIG. 1 the part of the system shown therein is repeated for each engine cylinder. The part of the system comprises a high pressure fuel pump including a reciprocable plunger 10 housed within a bore 11. The plunger is movable inwardly by the action of an engine driven cam 13 and outwardly by a compression spring 12. The inner end of the bore together with the plunger form a pumping chamber 14 which has an outlet connected to a fuel pressure actuated fuel injection nozzle 15 mounted to direct fuel into an engine combustion space.

Also communicating with the pumping chamber is a spill valve 16 having a valve member which is spring loaded by resilient means in the form of a helical spring S, to the open position. The valve member is coupled to an armature 17 which when a winding 18 is supplied with electric current, moves under the influence of the resulting magnetic field to move the valve member into engagement with a seating thereby to close the spill valve. Fuel is supplied to the bore 11 through a port 19 connected to a low pressure fuel supply 19A, when the plunger has moved outwardly a sufficient amount to uncover the port 19. As set forth in the Background and Summary of the Invention, it is common for a fuel system to employ a number of such valves. Accordingly, a second spill valve **16*a* is diagrammatically included in FIG. 1, it being understood that such valve is similar in structure and function to valve 16**, the description of which follows.

Assuming that the plunger has just started its inward movement so that the port 19 is closed, fuel will be displaced from the pumping chamber 14 and will flow to a drain through the open spill valve 16. If the spill valve is now closed by energising the winding 18, the fuel in the pumping chamber will be pressurized and when the pressure is sufficient, will open the injection nozzle 15 to allow fuel to flow into the combustion chamber. The fuel flow to the combustion chamber will continue so long as the spill valve is closed and the pumping plunger is moving inwardly. When the winding is de-energized the spill valve will open and the flow of fuel to the engine will cease. The cycle is then repeated each time fuel is to be supplied to the respective engine cylinder.

It will be appreciated that the amount of fuel supplied to the engine depends upon the time considered in terms of degrees of rotation of the engine camshaft, during which the spill valve is closed. In real time therefore and neglecting hydraulic effects, the period of spill valve closure reduces as the engine speed increases for a given quantity of fuel supplied to the engine.

An example of a power circuit for supplying the energizing current to the winding 18 is seen in FIG. 2. The circuit includes first and second terminals 20, 21 for connection to the positive and negative terminals respectively of a DC supply such as a battery. One end of the winding 18 is connected to terminal 20 by way of a first switch SW2 and the other end of the winding is connected by way of the series combination of a second switch SW1 and a resistor 22, to the terminal 21. The one end of the winding 18 is connected to the cathode of a diode 23 the anode of which is connected to the terminal 21 and the other end of the winding is connected to the anode of a diode 24 the cathode of which is connected to the terminal 20. The switches SW1 and SW2 are constituted by switching transistors and these are controlled by a control circuit 25. The control circuit is also supplied with the voltage developed across the resistor 22 this being representative of the current flowing in the resistor and the winding during the periods of closure of switch SW1.

FIG. 2 also shows an additional winding 18A which is associated with a second spill valve 16*a* of another section of the fuel system. The one end of the winding 18A is connected through switch SW2 and diode 23 to the terminals 20, 21 respectively and the other end of the winding 18A is connected to the anode of a diode 24A the cathode of which is connected to terminal 20. In addition the other end of the winding is connected by a switch SW3 to the junction of the switch SW1 and the resistor 22.

The upper portion of FIG. 3 shows a control voltage pulse which is generated within the control system 25 when it is required to close one of the spill valves. The lower portion of FIG. 3 represents the movement of the armature 17 and the valve member of the spill valve from the rest or open position to the closed or actuated position and back to the open position and the intermediate portion of FIG. 3 shows the varying current flow in the selected winding 18. The current profile is chosen to provide rapid closure of the spill valve with as will be explained, the facility to detect closure of the spill valve. In addition, the current profile allows for detection of when the valve member of the spill valve has moved to its fully open position.

Considering now the operation of the power circuit, after a time period A following the start of the control pulse, both switches SW1 and SW2 are turned on and this results in a rapid rise in the current flowing in the winding 18. The current is allowed to rise to a peak value PK and when this is detected switch SW2 is opened. The decay of current takes place at a low rate through the switch SW1, the resistor 22 and the diode 23. At a time B after the start of the control pulse switch SW1 is opened and this allows the current in the winding to decay at a high rate, energy being returned to the supply by way of the diodes 23 and 24. At a time period C after the start of the control pulse both switches SW1 and SW2 are closed so that the current flowing in the winding increases at a high rate until at the end of time period D following the start of the control pulse, switch SW2 is opened to allow the current to decay at a low rate.

During this period of decay the armature 17 reaches its actuated position and is brought to rest by virtue of the closure of the valve member of the spill valve onto its seating and at the instant the armature is brought to rest a small discontinuity or glitch $G_1$ occurs naturally in the waveform of the current. The glitch is detected and switch SW2 is closed to allow the current flow in the winding to increase to slightly above the so called mean holding current, the switch SW2 then being switched off and on to maintain the mean holding current. The spill valve is therefore held in the closed position.

It will be noted in the example, that the valve member does not start to move from the fully open position until the current flowing in the winding has almost reached the peak value.

Furthermore, at the end of the control pulse when both switches SW1 and SW2 are turned off, the valve member and armature 17 do not start to move to the open position until the current has fallen almost to zero. The opening movement continues and in order to detect when the spill valve is fully open, both switches are closed after a time period E following the end of the control pulse, switch SW2 being opened after a period F to allow a low rate of decay of current. During this period of decay the armature and valve member are brought to rest and a discontinuity or glitch $G_2$ occurs in the current flow. This is detected and switch SW1 is opened to allow the current to decay to zero.

The sequence as described is then repeated at the appropriate time for winding 18A with switch SW3 being controlled instead of switch SW1.

Figure 4:
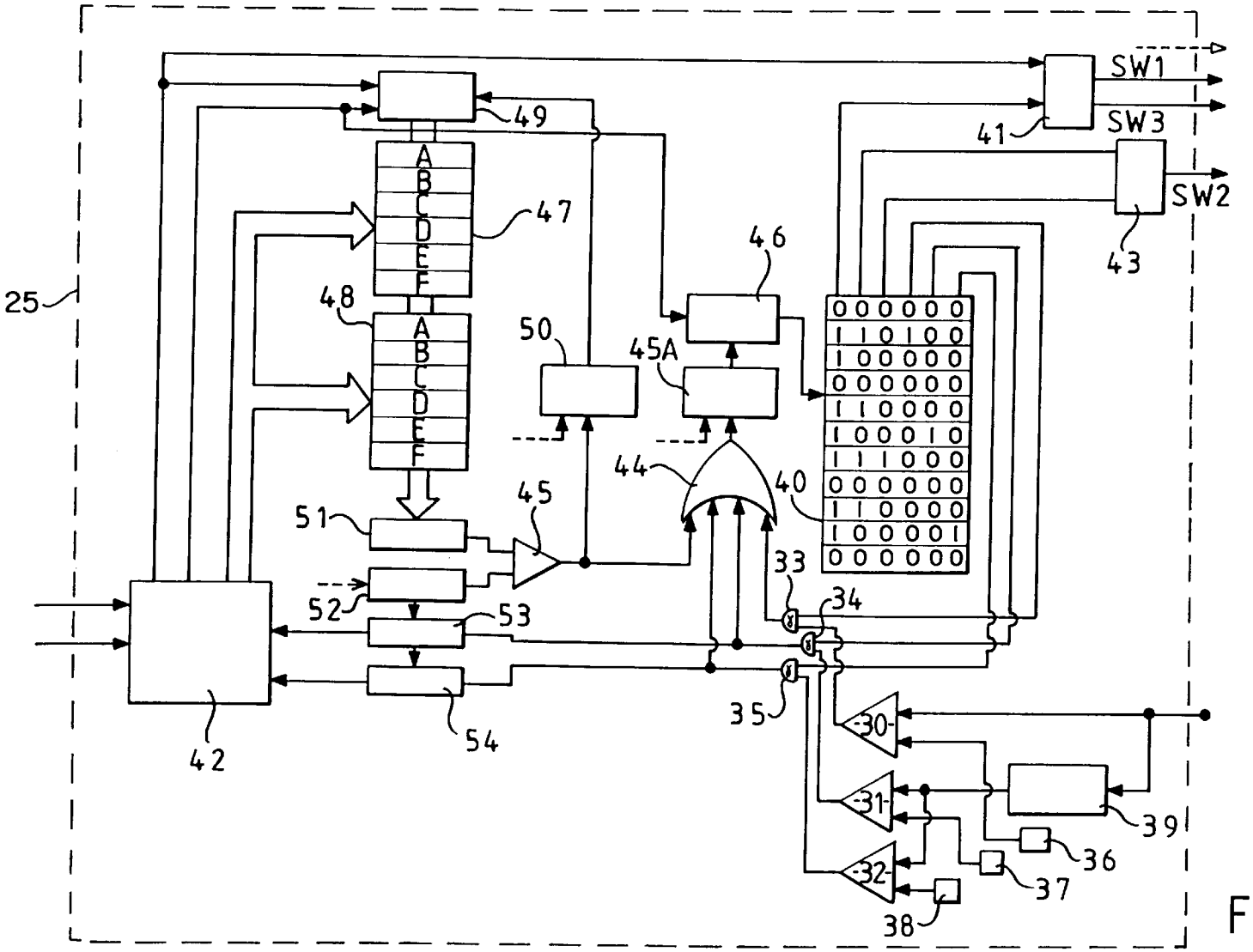
FIG. 4 shows one example of a control circuit for the power circuit shown in FIG. 2.

An example of the control circuit 25 is seen in FIG. 4 and this comprises three comparators 30, 31, 32 the outputs of which are applied to one input of respective AND gates 33, 34, 35

The comparator 30 has one input connected to a reference voltage source 36 and its other input connected to the junction of the switch SW1 and the resistor 22. The comparator 30 provides an output when the current flowing the winding 18 attains the peak value PK. The comparators 31 and 32 each have one input connected to reference voltage sources 37, 38 respectively and their other inputs to the output of a differentiating circuit 39 the input of which is connected to the junction of switch SW1 and resistor 22. Comparator 31 produces an output for the glitch generated when the spill valve closure occurs and comparator 32 produces an output when the glitch generated upon full opening of the spill valve occurs. The AND gates 33, 34, 35 constitute switches which are each controlled by respective channels of a switch setting register 40.

The selection and energization of the switches SW1, SW3 is effected by a selector circuit 41 having one output connected to one channel of the setting register 40 and a further input to which is applied a selector signal indicative of which of the switches SW1, SW3 is to be operated. The selector signal is derived from a microprocessor 42 the function of which will be described.

The switch SW2 is energized through a control module 43 which has two inputs connected to respective channels of the setting register 40. When both inputs are enabled the switch SW2 is switched on and off to provide the aforesaid mean value of current for the purpose of holding the spill valve closed. The control module 43 may incorporate a timer to provide the switching action or it may be responsive to the voltage developed across the resistor 22. When only the upper input as shown in the drawing is enabled switch SW2 remains closed.

The outputs of the AND gates 33, 34, 35 are applied to three inputs respectively of a four input OR gate 44 the other input of which is connected to the output of a time comparator 45. The output of the OR gate is connected to an incrementor 45A which is associated with an address generator 46 for the setting register 40. the address generator 46 is supplied with the control pulse (shown in FIG. 3) by the microprocessor 42.

The operation of the portion of the control circuit so far described is as follows. The switch setting register 40 is incremented at the end of each time period A, B, C, D, E, F, and also when the peak current PK and the glitches are detected. At the end of each time period a signal appears at the output of the time comparator 45 and is supplied to the OR gate 44 and when the peak value PK is detected and when the glitches naturally occuring are detected, signals appear at the outputs of the AND gates 33, 34, 35 respectively. The settings of the setting register 40 are also incremented at the start of the control pulse and also at the end of the control pulse.

The time intervals A, B, C, D, E, F, are stored in an addressable programable memory one such memory being indicated at 47. In practice because the operating characteristics of each spill valve will be different one such memory is provided for each spill valve of the fuel system and a second memory is indicated at 48. Associated will the memories is an address generator 49 which receives both the selector signal and the control pulse from the microprocessor 42 and also a signal generated by an address incrementor 50 the input of which is connected to the output of the time comparator 45. The selector signal through the address generator 49, determines which memory is to be addressed and the selected next time value is stored in a register 51 to be compared with the actual time provided by a timer 52, in the time comparator 45. When the actual and selected time values coincide an output is applied to the OR gate 44 and the next time value is selected by the action of the time address incrementor 50.

The times at which the glitches or discontinuities naturally occur are stored in two stores 53, 54 which are responsive to the output of the AND gates 34, 35. The time values stored in the stores are utilised by the microprocessor 42 to check the operation of the spill valves in particular to ensure that each spill valve is closed to initiate delivery of fuel, at the same time following the start of the control pulse and to determine the hold period.

The microprocessor 42 receives engine synchronisation pulses from transducers associated with the crankshaft and/or a camshaft of the engine and also an operator fuel demand signal. From the synchronisation pulses the engine speed and position can be determined so that the fuel is supplied to the correct engine combustion space at the desired time. The demand signal is processed along with the engine speed signal to determine the length of the control pulse so that the correct quantity of fuel is supplied to the engine. The microprocessor on the basis of stored information acts as a governor to control the engine speed and to ensure that the level of fuel supplied to the engine is such that the smoke emissions, and noise etc. do not exceed prescribed limits.

It is convenient to reset the timer 52, the address incrementors 50 and the incrementor 45A at the end of each cycle of operation of a valve and this can be achieved by reset signals generated by the microprocessors 42.

As previously stated the operating characteristics of the spill valves may differ and the stored time values in the memories 47, 48 will differ. The microprocessor can update the individual time values using the information derived from the time values in the stores 53 and 54.

Figure 5:
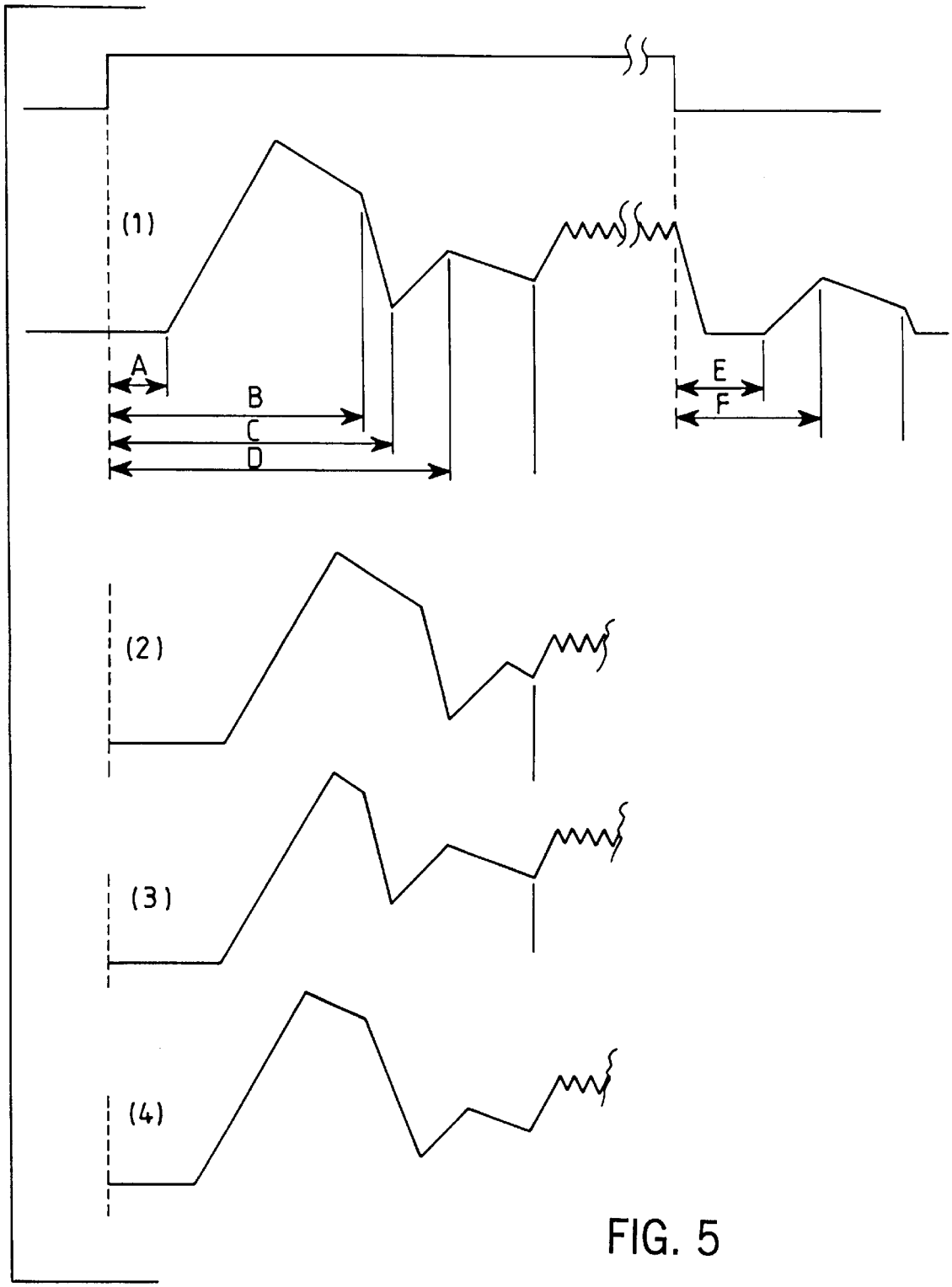
FIG. 5 shows modifications to the current waveform.

As an illustration one spill valve 16 and its actuator in the form of the armature 17, spring and winding 18 may have a faster response than another of the other spill valves. This may be due for example to a lower force exerted by the return spring. In this case the valve member will move more readily into engagement with its seating than those of the other spill valves. The instant of closure can be compensated for by altering the time interval A. This is illustrated in FIG. 5(2) where it will be seen as compared with FIG. 5(1) that all the time periods up to the attainment of the holding current have been extended. Although the instant of spill valve closure remains the same it will be noted that the time interval between the end of the time period D and closure of the valve member as indicated by the generation of the first glitch $G_1$, is reduced.

However, if the same current waveform is used so that the same energy is expended, the valve member of the spill valve having the faster response will have a higher velocity prior to its engagement with its seating with the result that there will be an increased tendency for the valve member to bounce from the seating. As a result the fuel delivery characteristics of the pump associated with that spill valve will be different.

One solution is shown in FIG. 5(3) in which the time period A is extended in the same manner as in FIG. 5(2) but the time periods B, C and D remain the same as those of FIG. 5(1). The peak value PK of current occurs at the same time following switch on but as compared with FIG. 5(1) the time lapse between the attainment of the peak value and the end of time period B is reduced. The practical effect is that energy is removed from the system and returned to the source of supply earlier in the cycle. As a result the velocity of the valve member at the instant of impact with its seating is reduced and there is therefore a reduced tendency for bounce to take place.

An alternative approach is to modify various of the time periods without modifying the peak value of current. An illustration of this approach is seen in FIG. 5(4). The time periods can be optimised according to an algorithm determined by experiment.

The modifications to the current waveform are easily achieved by altering the values of the time periods held in the memories 47, 48.

It would be possible in an engine fuel system to determine the operating characteristics of each spill valve and to utilise this information to determine the time periods and to store those time periods in the memories 47, 48. Such an arrangement has the disadvantage that it would not be possible to replace the spill valve and/or the associated actuator without having to update the stored information. The alternative approach is to use a learning system in which the operation of each spill valve is assessed and the current profile during closure of the spill valve gradually optimised.

In carrying out the learning system the spill valve is initially supplied with a current profile which from the peak value PK decays at the slower rate so as to allow for detection of the glitch which occurs on closure of the valve member onto its seating. Once the glitch has been detected the software of the microprocessor determines the time period A so as to ensure that all the spill valves of the fuel system close at the correct time in their cycles of operation. There then follows a process of optimisation to minimise power consumption whilst ensuring that the spill valve member closes as quickly as possible with the minimum of bounce. The times A, B, C, D are therefore adjusted during this process.

The glitch which occurs naturally on the attainment of the fully open position of the valve member can be used in the microprocessor to determine the length of the period during which the hold current is supplied to the winding. The flow of current which is required between the ends of the periods E and F causes a small retarding effect on the opening of the valve member but when the associated engine is operating at its full load rated speed it has no discernable influence on the opening of the valve member of the spill valve. However, when the engine is idling it may be convenient to increase the amplitude of the current pulse to slow the movement of the valve member towards its stop. In this manner bounce of the valve member can be minimised as also can the noise generated when the valve member engages its stop. Furthermore, the fuel pressure decay can be controlled to minimise cavitation effects and hydraulic noise. The amplitude of the current pulse can be optimised using a learning process.

The current profiles shown in FIGS. 3 and 5 utilise a period of slow rate of current decay following the attainment of the peak value of current and a further period during which current is supplied to the winding between the ends of time intervals C and D. These two periods can be eliminated in certain designs of spill valve. The effect is that following the attainment of the peak value of current, the current is allowed to decay quickly followed by a slow rate of decay until the closing glitch is detected. The control circuit as described can provide for this method of operation by modifying the contents of the switch setting register 40 and the contents of the memories 47, 48. In the examples described the amount of energy supplied to the winding has remained constant and the speed of operation of the spill valve determined by controlling the amount of that energy abstracted during the periods following the attainment of the peak value and the closing glitch. It is possible however to vary the peak value PK and for this purpose it is necessary to be able to vary the voltage provided by the reference source 36. As an alternative to sensing the peak value with the comparator 30 the period during which the current rises can be timed.

I claim:

1. A method of controlling the flow of current in a winding which forms part of a control valve of an engine fuel system, the valve including an armature movable by the magnetic field produced by the winding from a rest position to an actuated position, the armature being coupled to a valve member, the method comprising the steps of connecting the winding to a source of electric supply and allowing the current to rise to a singulary occurring peak value during which period the armature starts to move from its rest position, disconnecting the winding from the source of supply and allowing the current in the winding to steadily decay at a low rate, monitoring the current flow in the winding and detecting a naturally occurring discontinuity in the current flow which occurs as the current steadily decays at the low rate when the armature is instantaneously and actually brought to rest at the actuated position and modifying the current flow in the winding prior to the discontinuity by introducing a period of current decay at a high rate prior to the period of current decay at the low rate.

2. The method according to claim 1, in which the current flow in the winding is regulated to a hold value upon detection of the discontinuity.

3. The method according to claim 1, in which said period of current decay at the high rate is followed by a period during which the current flow in the winding is increased prior to said period of current decay at the low rate.

4. A method of controlling the flow of current in a winding which forms part of a control valve of an engine fuel system, the valve including an armature movable against the action of resilient means from a rest position to an actuated position, by the action of the magnetic field produced by the winding, the armature being coupled to a valve member, comprising the steps of connecting the winding to a source of supply and controlling the flow of current in the winding to effect movement of the armature to the actuated position and to hold the armature at the actuated position, disconnecting the winding from the source of supply to allow the armature to return to the rest position under the action of the resilient means, and prior to the attainment of the rest position, supplying current to the winding for a limited period to control the movement of the armature towards the rest position, said limited period of current supply being followed before the armature reaches its rest position, by a period of steadily current decay at a low rate to allow for detection of a nature occurring discontinuity in the current flowing in the winding which occurs when the armature instantaneously and actually attains the rest position.

5. A method of controlling the flow of current in the windings respectively of a plurality of control valves which form part of the fuel system of an engine, each valve including an armature movable by the magnetic field produced by the respective winding from a rest position to an actuated position, the control valves including valve means coupled to the respective armatures, the method comprising selecting which of the control valves is to be actuated, connecting the winding of the selected valve to a source of electric supply and allowing the current in the winding to rise to a peak value during which period the armature starts to move from its rest position, disconnecting the winding from the source of supply and allowing the current in the winding to decay, monitoring the current flow in the winding and detecting a naturally occuring discontinuity in the current flow which occurs when the armature is instantaneously brought to rest at its actuated position, supplying a holding current to the winding to maintain the armature at the actuated position for a period determined by the fuel requirement of the engine, repeating the process for the valves in turn, and modifying the profiles of current decay in the individual windings so as to vary the amount of energy abstracted from the windings whereby the armature of each valve attains its actuated position at the same time in the engine operating cycle and the movement of the armature is controlled as it approaches the actuated position.

6. The method according to claim 5, in which the modification of the current profile includes varying the rate of current decay.

7. The method according to claim 6, in which following the attainment of the peak value of current, the current is allowed to decay for a first period at a low rate and then for a second period at a high rate followed by a third period at a low rate during which the discontinuity is detected.

8. The method according to claim 7, in which there is interposed between said second and third periods a fourth period during which the flow of current in the winding is increased.

9. The method according to claim 7, in which said periods are timed, and the time values of said periods are stored.

10. The method according to claim 5, in which following the period of supply of holding current the current is allowed to decay at a high rate to zero, current flow then being re-established for a short period followed by decay at a low rate to allow detection of a further discontinuity in the current flow in the winding when the armature attains its rest position.

11. A control system for the fuel system of an engine, the fuel system including a plurality of control valves which control the supply of fuel to the combustion spaces of the engine respectively, each control valve including a winding, an armature movable from a rest position to an actuated position by the magnetic field produced when electric current is supplied to the winding, the armature being coupled to a valve member, a power circuit operable to control the current flow in the windings of the control valves in turn, control means for controlling the operation of the power circuit, said control means including first means for monitoring the current flow in the windings, said first means providing a first signal when the current flow in the selected winding attains a predetermined singularly occurring peak value and a second signal when the armature reaches its actuated position, and second means for controlling the flow of current in the selected winding following the attainment of the peak value of current, said second means acting to provide a first time period immediately following the attainment of the peak value during which the current in the winding is allowed to steadily decay at a low rate, immediately followed by a second period during which the current is allowed to decay at a high rate and a third period during which the current is allowed to decay at a low rate, and said second means includes memory means in which time values representative of said periods are stored for each valve wherein said first means provides said second signal in response to the detection of a naturally occurring discontinuity in the current in the selected winding which occurs when the armature actually reaches its actuated position, and wherein the third person is timed to ensure that the discontinuity occurs during the third period.

12. The control system according to claim 11, in which said second means acts to provide a fourth period intermediate said second and third periods during which the current flow in the selected winding is caused to increase.

13. The control system according to claim 12, in which said power circuit is utilized to control the decay of current and the mode of operation of the power circuit is changed at the end of each time period and in response to signals provided by said first means.

14. A method of controlling the flow of current in the windings respectively of a plurality of control valves which form part of the fuel system of an engine, each valve including an armature movable by the magnetic field produced by the respective winding from a rest position to an actuated position, the control valves including valve means coupled to the respective armatures, the method comprising selecting which of the control valves is to be actuated, connecting the winding of the selected valve to a source of electric supply and allowing the current in the windings to rise to a peak value during which period the armature starts to move from its rest position, disconnecting the winding from the source of supply and allowing the current in the winding to decay, monitoring the current flow in the winding and detecting the discontinuity in the current flow which occurs when the armature is brought to rest at its actuated position, supplying a holding current to the winding to maintain the armature at the actuated position for a period determined by the fuel requirement of the engine, repeating the process for the valves in turn, and modifying the profiles of current decay in the individual windings so as to vary the amount of energy abstracted from the windings whereby the armature of each valve attains its actuated position at the same time in the engine operating cycle and the movement of the armature is controlled as it approaches the actuated position, in which method following the period of supply holding current, the current is allowed to decay at a high rate to zero, current flow then being re-established for a short period followed by decay at a low rate to allow detection of a further discontinuity in the current flow in the winding when the armature attains its rest position.

* * * * *